US007210985B2

(12) United States Patent
Taylor

(10) Patent No.: US 7,210,985 B2
(45) Date of Patent: May 1, 2007

(54) SHAPED POLISHING PADS FOR BEVELING MICROFEATURE WORKPIECE EDGES, AND ASSOCIATED SYSTEMS AND METHODS

(75) Inventor: Theodore M. Taylor, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 11/413,661

(22) Filed: Apr. 27, 2006

(65) Prior Publication Data

US 2006/0189262 A1 Aug. 24, 2006

Related U.S. Application Data

(62) Division of application No. 10/913,028, filed on Aug. 6, 2004, now Pat. No. 7,066,792.

(51) Int. Cl.
*B24B 1/00* (2006.01)

(52) U.S. Cl. ..... 451/44; 451/65; 451/285

(58) Field of Classification Search ..... 451/41, 451/43, 44, 63, 65, 285–289, 921
See application file for complete search history.

(56) References Cited

U.S. PATENT DOCUMENTS 5,020,283 A 6/1991 Tuttle
5,069,002 A 12/1991 Sandhu et al.
5,081,796 A 1/1992 Schultz
5,177,908 A 1/1993 Tuttle
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic
5,245,796 A 9/1993 Miller et al.
RE34,425 E 11/1993 Schultz (Continued)

OTHER PUBLICATIONS

Kondo, Seiichi, et al., "Abrasive-Free Polishing for Copper Damascene Interconnection," Journal of the Electrochemical Society, vol. 147, No. 10, pp. 3907-3913, 2000.

*Primary Examiner*—Dung Van Nguyen
(74) *Attorney, Agent, or Firm*—Perkins Coie LLP

(57) ABSTRACT

Systems and methods for beveling microfeature workpiece edges are disclosed. A system in accordance with one embodiment is configured to remove material from a microfeature workpiece having a first face, a second face facing opposite from the first face, an edge surface between the first and second faces, and an edge at a juncture between the edge surface and one of the first and second faces. The system can include a carrier positioned to carry the workpiece with the first and second faces generally normal to an axis, and a first polishing pad having a support surface and a polishing surface facing generally away from the support surface. The polishing surface can have a first shape with at least one portion oriented at an acute angle relative to the axis and the support surface to remove material from the edge of the workpiece. A polishing pad support is positioned to carry the first polishing pad proximate to the carrier and is also configured to carry a second polishing pad having a polishing surface with a second shape configured to remove material from the first face of the workpiece while the workpiece rotates about the axis.

23 Claims, 7 Drawing Sheets

U.S. PATENT DOCUMENTS

| | | | | |
|---|---|---|---|---|
| 5,297,364 | A | | 3/1994 | Tuttle |
| 5,403,228 | A | | 4/1995 | Pasch |
| 5,421,769 | A | | 6/1995 | Schultz et al. |
| 5,433,651 | A | | 7/1995 | Lustig et al. |
| 5,449,314 | A | | 9/1995 | Meikle et al. |
| 5,486,129 | A | | 1/1996 | Sandhu et al. |
| 5,514,245 | A | | 5/1996 | Doan et al. |
| 5,533,924 | A | | 7/1996 | Stroupe et al. |
| 5,540,810 | A | | 7/1996 | Sandhu et al. |
| 5,618,381 | A | | 4/1997 | Doan et al. |
| 5,624,303 | A | | 4/1997 | Robinson |
| 5,643,060 | A | | 7/1997 | Sandhu et al. |
| 5,658,183 | A | | 8/1997 | Sandhu et al. |
| 5,658,190 | A | | 8/1997 | Wright et al. |
| 5,664,988 | A | | 9/1997 | Stroupe et al. |
| 5,679,065 | A | | 10/1997 | Henderson |
| 5,690,540 | A | | 11/1997 | Elliott et al. |
| 5,702,292 | A | | 12/1997 | Brunelli et al. |
| 5,730,642 | A | | 3/1998 | Sandhu et al. |
| 5,733,176 | A | | 3/1998 | Robinson et al. |
| 5,736,427 | A | | 4/1998 | Henderson |
| 5,738,567 | A | | 4/1998 | Manzonie et al. |
| 5,747,386 | A | | 5/1998 | Moore |
| 5,792,709 | A | | 8/1998 | Robinson et al. |
| 5,795,218 | A | | 8/1998 | Doan et al. |
| 5,795,495 | A | | 8/1998 | Meikle |
| 5,807,165 | A | | 9/1998 | Uzoh et al. |
| 5,823,855 | A | | 10/1998 | Robinson |
| 5,830,806 | A | | 11/1998 | Hudson et al. |
| 5,851,135 | A | | 12/1998 | Sandhu et al. |
| 5,868,896 | A | | 2/1999 | Robinson et al. |
| 5,871,392 | A | | 2/1999 | Meikle et al. |
| 5,879,222 | A | | 3/1999 | Robinson |
| 5,882,248 | A | | 3/1999 | Wright et al. |
| 5,893,754 | A | | 4/1999 | Robinson et al. |
| 5,895,550 | A | | 4/1999 | Andreas |
| 5,910,043 | A | | 6/1999 | Manzonie et al. |
| 5,919,082 | A | | 7/1999 | Walker et al. |
| 5,934,980 | A | | 8/1999 | Koos et al. |
| 5,938,801 | A | | 8/1999 | Robinson |
| 5,940,946 | A | | 8/1999 | Yamawaki et al. |
| 5,945,347 | A | | 8/1999 | Wright |
| 5,954,912 | A | | 9/1999 | Moore |
| 5,967,030 | A | | 10/1999 | Blalock |
| 5,972,792 | A | | 10/1999 | Hudson |
| 5,976,000 | A | | 11/1999 | Hudson |
| 5,980,363 | A | | 11/1999 | Meikle et al. |
| 5,981,396 | A | | 11/1999 | Robinson et al. |
| 5,989,470 | A | | 11/1999 | Doan et al. |
| 5,990,012 | A | | 11/1999 | Robinson et al. |
| 5,994,224 | A | | 11/1999 | Sandhu et al. |
| 5,997,384 | A | | 12/1999 | Blalock |
| 6,001,007 | A | * | 12/1999 | Maeda et al. ..... 451/398 |
| 6,036,586 | A | | 3/2000 | Ward |
| 6,039,633 | A | | 3/2000 | Chopra |
| 6,040,245 | A | | 3/2000 | Sandhu et al. |
| 6,054,015 | A | | 4/2000 | Brunelli et al. |
| 6,062,958 | A | | 5/2000 | Wright et al. |
| 6,066,030 | A | | 5/2000 | Uzoh |
| 6,074,286 | A | | 6/2000 | Ball |
| 6,083,085 | A | | 7/2000 | Lankford |
| 6,090,475 | A | | 7/2000 | Robinson et al. |
| 6,110,820 | A | | 8/2000 | Sandhu et al. |
| 6,116,988 | A | | 9/2000 | Ball |
| 6,120,354 | A | | 9/2000 | Koos et al. |
| 6,135,856 | A | | 10/2000 | Tjaden et al. |
| 6,136,043 | A | | 10/2000 | Robinson et al. |
| 6,139,402 | A | | 10/2000 | Moore |
| 6,143,123 | A | | 11/2000 | Robinson et al. |
| 6,143,155 | A | | 11/2000 | Adams et al. |
| 6,152,808 | A | | 11/2000 | Moore |
| 6,176,763 | B1 | | 1/2001 | Kramer et al. |
| 6,176,992 | B1 | | 1/2001 | Talieh |
| 6,186,870 | B1 | | 2/2001 | Wright et al. |
| 6,187,681 | B1 | | 2/2001 | Moore |
| 6,191,037 | B1 | | 2/2001 | Robinson et al. |
| 6,193,588 | B1 | | 2/2001 | Carlson et al. |
| 6,196,899 | B1 | | 3/2001 | Chopra et al. |
| 6,200,901 | B1 | | 3/2001 | Hudson et al. |
| 6,203,404 | B1 | | 3/2001 | Joslyn et al. |
| 6,203,407 | B1 | | 3/2001 | Robinson |
| 6,203,413 | B1 | | 3/2001 | Skrovan |
| 6,206,754 | B1 | | 3/2001 | Moore |
| 6,206,756 | B1 | | 3/2001 | Chopra et al. |
| 6,206,759 | B1 | | 3/2001 | Agarwal et al. |
| 6,210,257 | B1 | | 4/2001 | Carlson |
| 6,213,845 | B1 | | 4/2001 | Elledge |
| 6,218,316 | B1 | | 4/2001 | Marsh |
| 6,220,934 | B1 | | 4/2001 | Sharples et al. |
| 6,227,955 | B1 | | 5/2001 | Custer et al. |
| 6,234,874 | B1 | | 5/2001 | Ball |
| 6,234,877 | B1 | | 5/2001 | Koos et al. |
| 6,234,878 | B1 | | 5/2001 | Moore |
| 6,237,483 | B1 | | 5/2001 | Blalock |
| 6,244,944 | B1 | | 6/2001 | Elledge |
| 6,250,994 | B1 | | 6/2001 | Chopra et al. |
| 6,251,785 | B1 | | 6/2001 | Wright |
| 6,254,460 | B1 | | 7/2001 | Walker et al. |
| 6,261,151 | B1 | | 7/2001 | Sandhu et al. |
| 6,261,163 | B1 | | 7/2001 | Walker et al. |
| 6,267,650 | B1 | | 7/2001 | Hembree |
| 6,273,786 | B1 | | 8/2001 | Chopra et al. |
| 6,273,796 | B1 | | 8/2001 | Moore |
| 6,273,797 | B1 | | 8/2001 | Becker et al. |
| 6,273,800 | B1 | | 8/2001 | Walker et al. |
| 6,276,996 | B1 | | 8/2001 | Chopra |
| 6,277,015 | B1 | | 8/2001 | Robinson et al. |
| 6,290,579 | B1 | | 9/2001 | Walker et al. |
| 6,296,557 | B1 | | 10/2001 | Walker |
| 6,306,012 | B1 | | 10/2001 | Sabde |
| 6,306,014 | B1 | | 10/2001 | Walker et al. |
| 6,306,768 | B1 | | 10/2001 | Klein |
| 6,309,282 | B1 | | 10/2001 | Wright et al. |
| 6,312,319 | B1 | * | 11/2001 | Donohue et al. ..... 451/56 |
| 6,312,558 | B2 | | 11/2001 | Moore |
| 6,313,038 | B1 | | 11/2001 | Chopra et al. |
| 6,325,702 | B2 | | 12/2001 | Robinson |
| 6,328,632 | B1 | | 12/2001 | Chopra |
| 6,331,135 | B1 | | 12/2001 | Sabde et al. |
| 6,331,139 | B2 | | 12/2001 | Walker et al. |
| 6,331,488 | B1 | | 12/2001 | Doan et al. |
| 6,350,180 | B2 | | 2/2002 | Southwick |
| 6,350,691 | B1 | | 2/2002 | Lankford |
| 6,352,466 | B1 | | 3/2002 | Moore |
| 6,354,919 | B2 | | 3/2002 | Chopra |
| 6,354,923 | B1 | | 3/2002 | Lankford |
| 6,354,930 | B1 | | 3/2002 | Moore |
| 6,358,122 | B1 | | 3/2002 | Sabde et al. |
| 6,358,127 | B1 | | 3/2002 | Carlson et al. |
| 6,358,129 | B2 | | 3/2002 | Dow |
| 6,361,400 | B2 | | 3/2002 | Southwick |
| 6,361,417 | B2 | | 3/2002 | Walker et al. |
| 6,361,832 | B1 | | 3/2002 | Agarwal et al. |
| 6,364,749 | B1 | | 4/2002 | Walker |
| 6,364,757 | B2 | | 4/2002 | Moore |
| 6,368,190 | B1 | | 4/2002 | Easter et al. |
| 6,368,193 | B1 | | 4/2002 | Carlson et al. |
| 6,368,194 | B1 | | 4/2002 | Sharples et al. |
| 6,368,197 | B2 | | 4/2002 | Elledge |
| 6,376,381 | B1 | | 4/2002 | Sabde |
| 6,383,934 | B1 | | 5/2002 | Sabde et al. |
| 6,387,289 | B1 | | 5/2002 | Wright |
| 6,395,620 | B1 | | 5/2002 | Pan et al. |
| 6,402,884 | B1 | | 6/2002 | Robinson et al. |

6,409,586 B2 6/2002 Walker et al.
6,428,386 B1 8/2002 Bartlett
6,447,369 B1 9/2002 Moore
6,467,120 B1 10/2002 Ziemins et al.
6,498,101 B1 12/2002 Wang
6,511,576 B2 1/2003 Klein
6,520,834 B1 2/2003 Marshall
6,533,893 B2 3/2003 Sabde et al.
6,547,640 B2 4/2003 Hofmann
6,548,407 B1 4/2003 Chopra et al.
6,558,232 B1 5/2003 Kajiwara et al.
6,579,799 B2 6/2003 Chopra et al.
6,592,443 B1 7/2003 Kramer et al.
6,609,947 B1 8/2003 Moore
6,623,329 B1 9/2003 Moore
6,652,764 B1 11/2003 Blalock
6,663,472 B2 12/2003 Lim et al.
6,664,189 B1 12/2003 Lin et al.
6,666,749 B2 12/2003 Taylor
6,666,751 B1 12/2003 Wang
6,722,964 B2 4/2004 Kimura et al.
2006/0030242 A1 2/2006 Taylor

* cited by examiner

SHAPED POLISHING PADS FOR BEVELING MICROFEATURE WORKPIECE EDGES, AND ASSOCIATED SYSTEMS AND METHODS

CROSS-REFERENCE TO RELATED APPLICATION

This application is a divisional of U.S. patent application Ser No. 10/913,028, filed Aug. 6, 2004 now U.S. Pat. No. 7,066,792, which is incorporated herein by reference in its entirety.

TECHNICAL FIELD

The present invention relates generally to shaped polishing pads for beveling microfeature workpiece edges, along with associated systems and methods.

BACKGROUND

Microfeature workpieces (e.g., round wafers) are typically provided to microfeature device manufacturers with beveled edges. A variety of techniques are used to bevel the edges, including applying plasma jets to the workpiece, running a polishing tape along the edges, and contacting the edges with a conical abrasive surface. During the course of processing, layers of materials are built up on the microfeature workpiece and then planarized using mechanical and chemical-mechanical planarization and polishing processes (collectively "CMP"). As a result of these processes, the initially beveled edges of the microfeature workpiece also receive deposits, which can reduce or eliminate the beveled shape of these edges. During subsequent planarization operations, these edges can be a source for defects. In particular, the deposited layers at and near the edge of the workpiece may tend to peel or delaminate, causing defects in the edge region of the microfeature workpiece. Defects in the edge region can migrate to other portions of the microfeature workpiece during subsequent processing steps, so that the defects are not necessarily limited to only the peripheral region of the workpiece. Furthermore, particles released from the edge region can cause scratch defects at the parts of the workpiece as the particles are dragged across the workpiece surface during processing.

One proposed solution to the foregoing problem is to use the same beveling tools that initially bevel the edges of the workpiece to also bevel the workpiece at selected points during microfeature device fabrication. FIG. 1A illustrates a tool 10 configured for such a purpose. The tool 10 can include a plurality of processing stations 12 (e.g., beveling stations) housed in an enclosure 11. Input/output stations 13 are used to transfer microfeature workpieces into and out of the enclosure 11. A control and display panel 14 is used to control the motion of the workpieces within the enclosure 11 and the processes taking place at the processing stations 12.

FIG. 1B illustrates components of one such processing station 12. The components can include a wafer carrier 60 carrying a wafer 50 having two edges 54. A shaft 42 carries a conical support 40 having a conical, concave surface. An abrasive liner 20 is attached to the conical support 40 and both the conical support 40 and the wafer carrier 60 are rotated, as indicated by arrows R. The wafer 50 is then brought into contact with the spinning abrasive liner 20 to bevel one edge 54. Optionally, the remaining edge 54 can also be beveled after the wafer 50 is inverted on the carrier 60.

One drawback with the foregoing approach is that the tool 10, while effective for beveling workpiece edges, can be expensive. In particular, the tool can be expensive to acquire and, because it occupies a relatively large amount of clean-room floor space, can be expensive to own and maintain. Furthermore, the risk of damage to microfeature workpieces as they are shuttled back and forth between an edge bevel tool 10 and a CMP tool can further increase the overall cost of using such a tool.

DETAILED DESCRIPTION

Figure 1A:
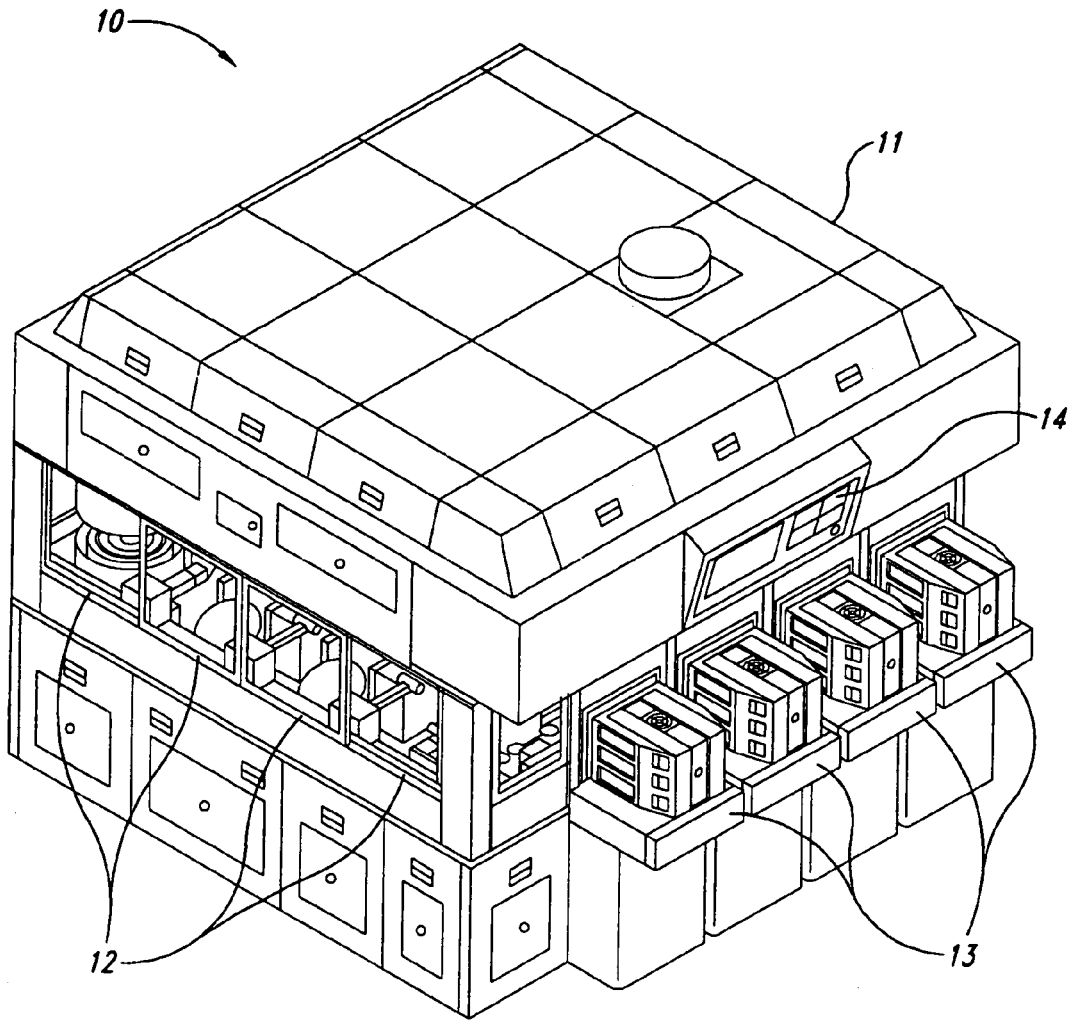
Fig. 1A (Prior Art)
FIGS. 1A and 1B illustrate a tool for beveling the edges of microfeature workpieces in accordance with the prior art.
Figure 1B:
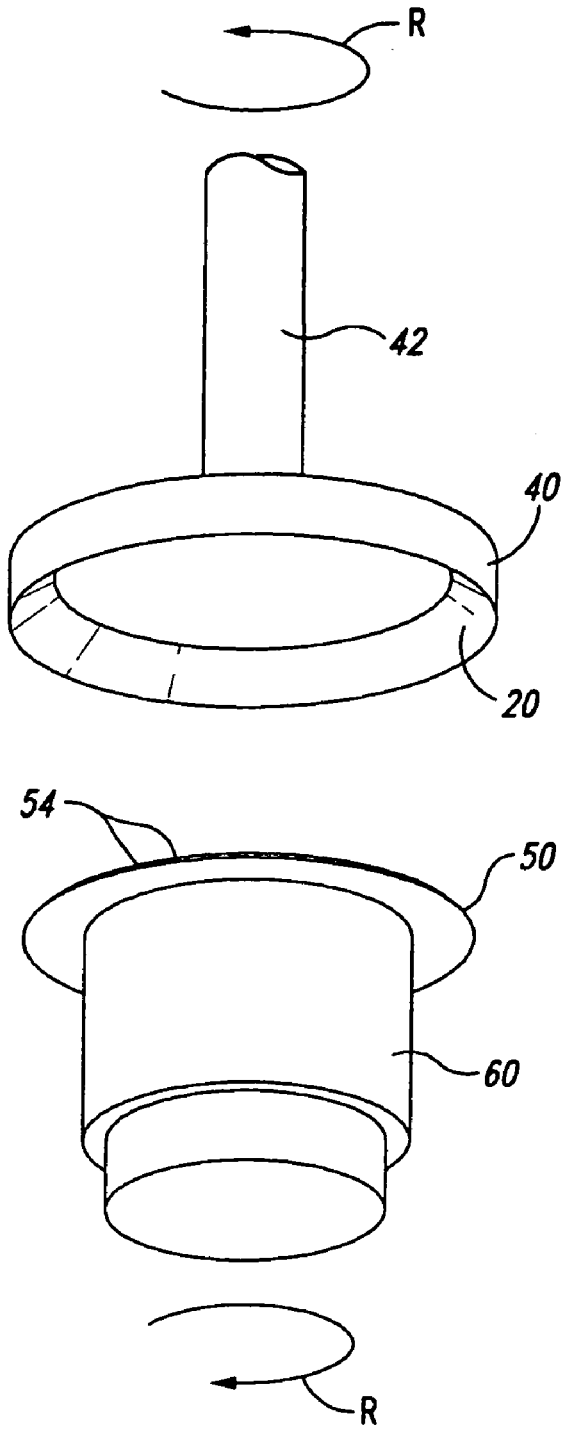

The present invention is directed toward systems and methods for beveling microfeature workpiece edges. A system in accordance with one aspect of the invention is configured to remove material from a microfeature workpiece having a first face, a second face facing opposite from the first face, an edge surface between the first and second faces, and an edge at a juncture between the edge surface and one of the first and second faces. The system can include a carrier positioned to carry the microfeature workpiece with the first and second faces generally normal to an axis. The system can further include a first polishing pad having a support surface and a polishing surface facing generally away from the support surface. The polishing surface can have a first shape, with at least one portion oriented at an acute angle relative to the axis and the support surface to remove material from the edge of the microfeature workpiece. A polishing pad support is positioned to carry the first polishing pad proximate to the carrier with the polishing surface facing toward the carrier. The polishing pad support can be configured to carry a second polishing pad in lieu of the first, the second polishing pad having a polishing surface with a second shape different than the first shape. The second shape can be configured to remove material from the first face of the microfeature workpiece while the microfeature workpiece rotates about the axis.

In a particular embodiment, the first polishing pad can have a generally circular planform shape, and the at least one portion of the pad can form a rim that extends circumferentially around at least part of the pad. In another embodiment, the at least one portion of the pad can include first and second portions facing at least partially toward each other, and a third portion (between the first and second portions) oriented generally normal to the axis.

A system in accordance with another aspect of the invention can include a carrier positioned to carry the microfeature workpiece with the first and second faces generally normal to an axis, a polishing pad support positioned proximate to the carrier, and a compliant polishing pad carried by the polishing pad support. The polishing pad can include a support surface facing toward the polishing pad support, and a polishing surface facing generally away from the support surface. The polishing surface can have at least one portion oriented at an acute angle relative to the axis and non-parallel to the support surface to remove material from the edge of the microfeature workpiece.

A system in accordance with yet another aspect of the invention includes a carrier positioned to carry a microfeature workpiece with the first face at a polishing plane. The system can further include a first polishing pad support, and a first polishing pad carried by the first polishing pad support. The first polishing pad can have a first polishing surface oriented generally parallel to the polishing plane. The system can further include a second polishing pad support carrying a second polishing pad. The second polishing pad can have a second polishing surface that is non-parallel to the polishing plane.

A method in accordance with yet another aspect of the invention includes positioning a microfeature workpiece at a processing tool, contacting the edge of the microfeature workpiece with a polishing surface of a polishing pad while the polishing surface is non-parallel to the first face of the workpiece, and removing material from the edge of the microfeature workpiece by rotating at least one of the microfeature workpiece and the polishing pad relative to the other about an axis generally normal to the first face of the workpiece while the edge contacts the polishing surface. The method can further include removing material from the first face of the workpiece without removing the workpiece from the processing tool.

As used herein, the terms "microfeature workpiece" and "workpiece"refer to substrates on and/or in which microfeature devices are integrally formed. Typical microfeature devices include microfeature circuits or components, thin-film recording heads, data storage elements, microfluidic devices, and other products. Micromachines and micromechanical devices are included within this definition because they are manufactured using much of the same technology that is used in the fabrication of integrated circuits. The substrates can be semiconductive pieces (e.g., doped silicon wafers and gallium arsenide wafers), nonconductive pieces (e.g., various ceramic substrates) or conductive pieces. In some cases, the workpieces are generally round, and in other cases the workpieces have other shapes, including rectilinear shapes. Several embodiments of systems and methods for removing material from the edges of microfeature workpieces are described below. A person skilled in the relevant art will understand, however, that the invention may have additional embodiments, and that the invention may be practiced without several of the details of the embodiments described below with reference to FIGS. 2–7B.

Figure 2:
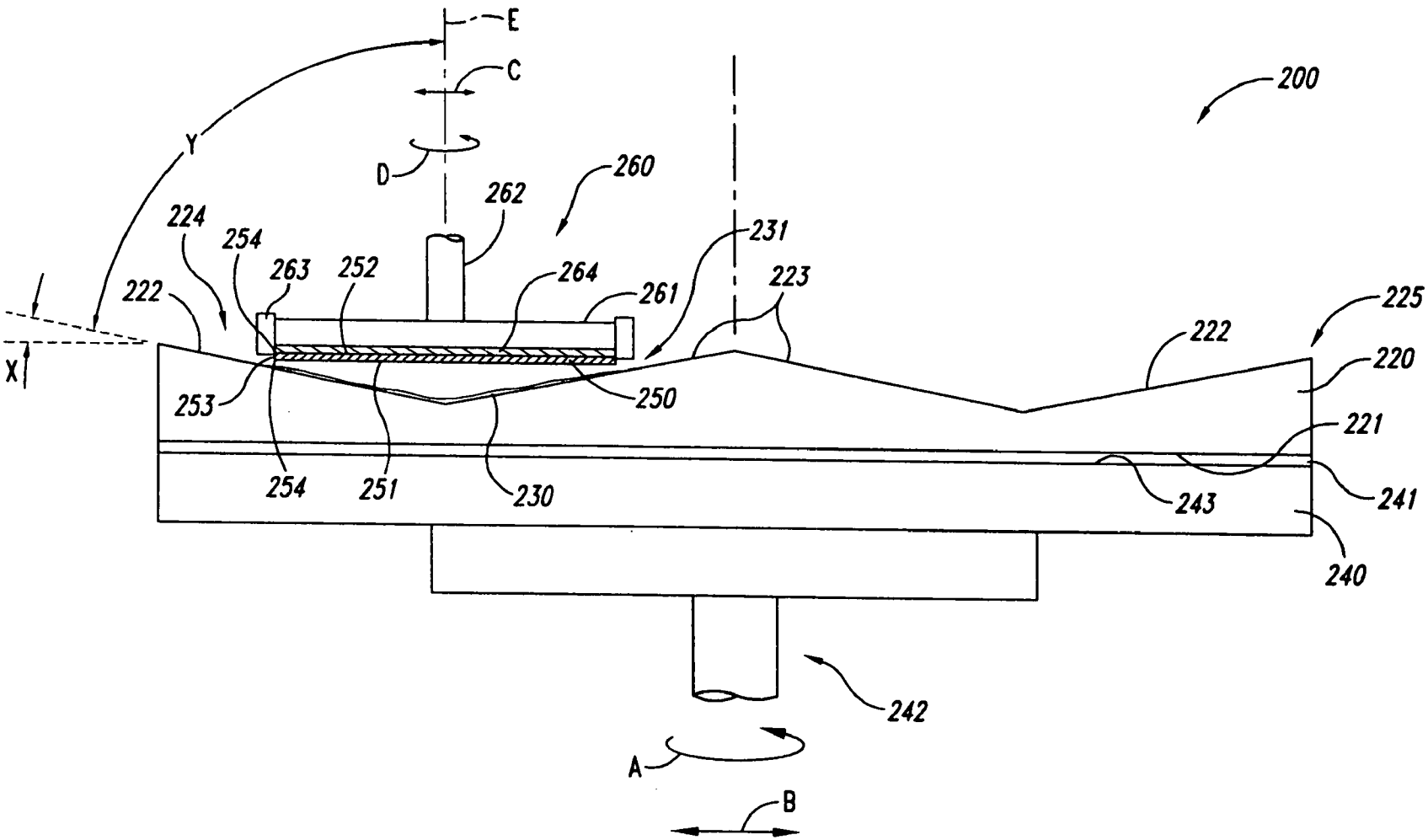
FIG. 2 is a partially schematic, cross-sectional illustration of a system for beveling the edges of a microfeature workpiece in accordance with an embodiment of the invention.

FIG. 2 is a partially schematic, side elevational view of a system 200 having a polishing pad 220 shaped to bevel the edges of a microfeature workpiece 250. The polishing pad 220 can be supported on an existing platen or pad support 240 that is also configured to carry existing CMP polishing pads. Accordingly, the polishing pad 220 can be installed and controlled using existing hardware. As will be described in greater detail below, this and other related features can provide a lower cost, more efficient way to remove material from the edges of the microfeature workpiece 250.

The system 200 can include the polishing pad 220 carried on the polishing pad support 240, with an optional underpad 241 positioned between the polishing pad 220 and the pad support 240. A drive assembly 242 can rotate the pad support 240 and the polishing pad 220 (as indicated by arrow A). The drive assembly 242 can also reciprocate the pad support 240 and the polishing pad 220 (as indicated by arrow B). A polishing liquid 230 can be disposed on the polishing pad 220, and the polishing pad 220 (with or without the polishing liquid 230) can form a polishing medium 231 for removing material from the microfeature workpiece 250.

The microfeature workpiece 250 can include a first face 251, a second face 252 facing generally opposite from the first face 251, and an edge surface 253 between the first face 251 and the second face 252. The edge surface 253 can form one edge 254 at its juncture with the first face 251 and another edge 254 at its juncture with the second face 252. The edges 254 are shown as sharp 90° corners in FIG. 5, but can have other shapes in other embodiments and/or as the edges 254 are beveled. The beveled edges 254 can extend inwardly from the edge surface 253 by a distance of up to about three millimeters in one embodiment, and by other distances in other embodiments. The following discussion focuses on beveling the edge 254 between the first face 251 and the edge surface 253, but it will be understood by those of ordinary skill in the art that the methods and systems described below in this context may apply equally to the edge 254 between the second face 252 and the edge surface 253.

The microfeature workpiece 250 can be supported relative to the polishing pad 220 with a carrier 260. Accordingly, the carrier 260 can include a carrier head 261 and, optionally, a resilient pad 264 that supports the workpiece 250 relative to the polishing pad 220. The carrier 260 can include a carrier actuator assembly 262 that translates the carrier head 261 and the workpiece 250 (as indicated by arrow C) and/or rotates the carrier head 261 and the workpiece 250 (as indicated by arrow D). The carrier head 261 can include a vacuum chuck or other arrangement for releasably holding the microfeature workpiece 250. An optional and independently actuatable retainer ring 263 can prevent the microfeature workpiece 250 from slipping out from under the carrier head 261. The relative movement between the polishing pad 220 and the workpiece 250 chemically and/or chemically-mechanically removes material from the workpiece 250 during polishing and/or planarization, as described in greater detail below.

The polishing pad 220 can include a support surface 221 that directly engages a corresponding interface surface 243 of the pad support 240, or engages an underpad 241 positioned between the pad support 240 and the polishing pad 220. Accordingly, the support surface 221 faces generally toward the pad support 240. The polishing pad 220 can further include a polishing surface 224 facing generally opposite from the support surface 221. Some or all of the polishing surface 224 can be inclined at an acute angle X relative to the first face 251 of the microfeature workpiece 250. Accordingly, these portions of the polishing surface 224 can also be oriented at an acute angle Y relative to an axis E that extends generally normal to the first and second faces 251, 252. As a result, these portions of the polishing surface 224 can be positioned to bevel the edge 254 between the first face 251 and the edge surface 253.

In a particular embodiment, the polishing surface 224 can include a first portion 222 that extends circumferentially around a peripheral region of the polishing pad 220 to form a rim 225. The polishing surface 224 can also include a second portion 223 disposed annularly inwardly from the first portion 222 to form a generally conical, central surface. The carrier 260 can support the microfeature workpiece 250 so that the edge 254 contacts both the first portion 222 and the second portion 223. As the carrier 260 and/or the pad support 240 rotate relative to each other, the first and second portions 222, 223 of the polishing surface 224 contact and bevel the edge 254 by removing material from the edge 254. When the carrier 261 includes a retainer ring 263, the retainer ring 263 can be elevated or removed so as not to interfere with the bevel process. Accordingly, the forces holding the microfeature workpiece 250 to the carrier head 261 can be strong enough to withstand the transverse force (e.g., directed out of the plane of FIG. 2) applied to the microfeature workpiece 250 as it contacts the first and second portions 222, 223.

Figure 3:
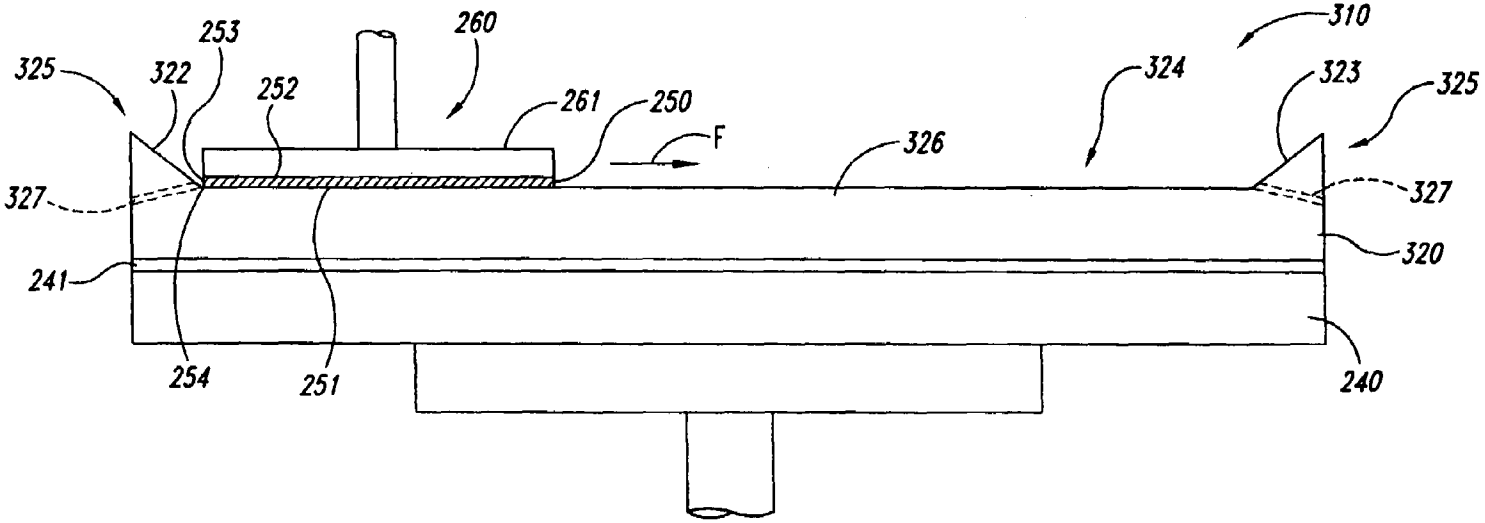
FIG. 3 is a partially schematic, cross-sectional illustration of a system for removing material from both the edges and faces of microfeature workpieces, in accordance with another embodiment of the invention.

FIG. 3 illustrates a system 310 having a polishing pad 320 configured in accordance with another embodiment of the invention. The polishing pad 320 can include a polishing surface 324 having an annular rim 325 that includes a first portion 322 facing at least partially toward a second portion 323. The first and second portions 322, 323 can be oriented at an acute angle relative to the first face 251 of the microfeature workpiece 250, in a manner generally similar to that described above with reference to FIG. 2. The polishing surface 324 can also include a third portion 326 positioned between the first portion 322 and the second portion 323 and oriented generally parallel to the first face 251 (e.g., at a polishing plane positioned to remove material from the first face 251). Accordingly, an operator can initially position the workpiece 250 with the edge 254 in contact with the first portion 322 of the polishing surface 324 to bevel the edge 254. After material has been removed from the edge 254, the operator can move the workpiece 250 (e.g., by moving the carrier 260) inwardly away from the rim 325, as indicated by arrow F. With the microfeature workpiece 250 in this position, the operator can remove material from the first face 251. Accordingly, the same polishing pad 320 can be used to remove material from both the edge 254 and the first face 251.

In a particular aspect of an embodiment shown in FIG. 3, the polishing pad 320 can include one or more relief channels 327 positioned in the rim 325. The relief channels 327 can be sized to receive material removed from the edge 254 of the microfeature workpiece 250. Accordingly, this material can be conducted away from the polishing surface 324. An advantage of this arrangement is that the material removed from the edge 254 can be less likely to be conveyed to the third portion 326 of the polishing surface 324, where it can scratch or otherwise damage the first face 251 during CMP operations.

The operator can control the force applied to the workpiece 250 (as well as the orientation of the workpiece 250) to assist in selectively removing material from either the edge 254 or the first face 251. For example, when the microfeature workpiece 250 is positioned against the rim 325, the downforce applied to the workpiece 250 can be reduced so as to reduce or eliminate the amount of material removed from the first face 251 while material is being removed from the edge 254. In a particular aspect of this embodiment, the gripping force applied to the workpiece 250 by the carrier 260 can be sufficient to allow the carrier 260 to force the edge 254 of the workpiece 250 laterally outwardly against the rim 325, without applying a significant downforce on the workpiece 250, and without causing the workpiece 250 to slip out from under the carrier head 261. In some embodiments, the retainer ring 263 described above with reference to FIG. 2 can help prevent the workpiece 250 from slipping out from under the carrier head 261, so long as the retainer ring 263 does not interfere with the rim 325. Alternatively, the gripping force between the carrier head 261 and the workpiece 250 can be sufficient to prevent the workpiece from slipping out, even without the presence of the retainer ring 263.

In a further particular embodiment, the carrier 260 can lift the workpiece 250 above the third portion 326 of the polishing surface 324, while engaging the workpiece edge 254 with the polishing pad rim 325, thereby ensuring that material is not removed from the first face 251 while material is being removed from the edge 254. An advantage of arrangements that limit or eliminate the amount of material removed from the first face 251 while material is being removed from the edge 254 is that the likelihood for damaging the first face 251 with material removed from the edge 254 can be reduced or eliminated.

In other arrangements, the composition of the polishing pad 320 (and in particular, the polishing surface 324) can be controlled to selectively remove material from the workpiece edge 254 more quickly than from the first face 251. For example, the first and second portions 322, 323 can be formed from constituents that have a higher material removal rate than do constituents of the third portion 326. In particular arrangements, the first and second portions 322, 323 can have a higher abrasiveness and/or hardness than the third portion 326, and in other arrangements, other attributes of the polishing surface 324 can be selected to produce different polishing rates.

Figure 4B:
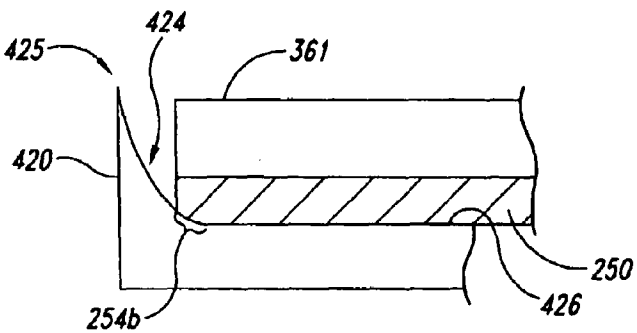
FIGS. 4A and 4B illustrate a polishing pad having a curved surface for controlling the shape of a bevel applied to a microfeature workpiece, in accordance with another embodiment of the invention.
Figure 4A:
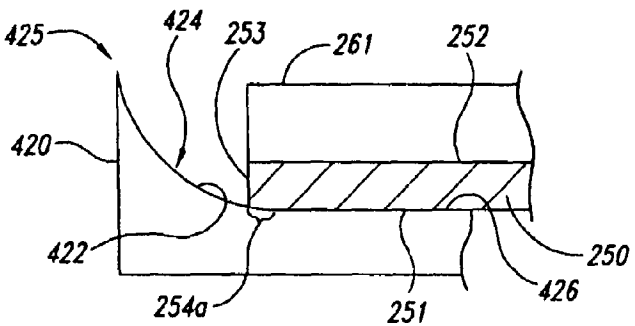
Figure 5:
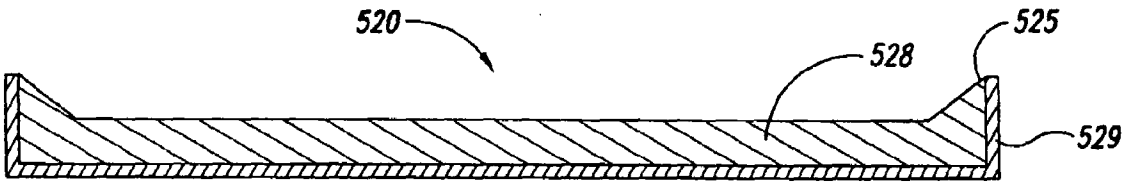
FIG. 5 illustrates a polishing pad assembly that includes a generally rigid support carrying a polishing pad material, in accordance with another embodiment of the invention.

In the embodiments described above with reference to FIGS. 2 and 3, the rims of the polishing pads have generally flat, conical, inwardly facing surfaces. In another embodiment, the rim can have a curved surface so that the angle between the polishing surface and a line normal to the workpiece faces 251, 252 varies radially. For example, referring now to FIG. 4A, a polishing pad 420 in accordance with another aspect of the invention can include a polishing surface 424 having a first portion 422 forming a rim 425 that has a curved cross sectional shape. An advantage of the curved polishing surface 424 is that it can be used to control the shape and size of the bevel applied to the edge of the workpiece 250. For example, in an embodiment shown in FIG. 4A, the workpiece 250 can be positioned so that contact with the polishing surface 424 produces a relatively gradual or shallow beveled edge 254*a*. By moving the workpiece 250 outwardly, the edge can contact a steeper portion of the rim 425. For example, referring now to FIG. 4B, the workpiece 250 has been positioned further outward than is shown in FIG. 4A. Accordingly, the edge 254*b* has a steeper bevel. Because the polishing pad 420 is compliant, the polishing surface 424 can flex at least somewhat as the workpiece 250 is moved outwardly, which can also steepen the bevel angle. In another embodiment, as described above, the workpiece 250 can be elevated above a central portion 426 to contact a steeper portion of the rim 425.

In the embodiments described above with reference to FIGS. 2–4B, the polishing pad, and in particular, the first portion, second portion and rim of the polishing pads, are self-supporting. Accordingly, these portions of the polishing pads can retain their shapes and positions when the polishing pads rest on the pad support. In other embodiments, the polishing pad can be so compliant that these portions of the pad are not self-supporting. For example, referring now to FIG. 5, a polishing pad assembly 520 in accordance with an embodiment of the invention includes a compliant non-self-supporting polishing pad material 528 that is attached to a generally rigid support 529. The support 529 can extend upwardly adjacent to a rim 525 of the polishing pad material 528 to provide support for the polishing pad material 528 in this region.

Figure 6:
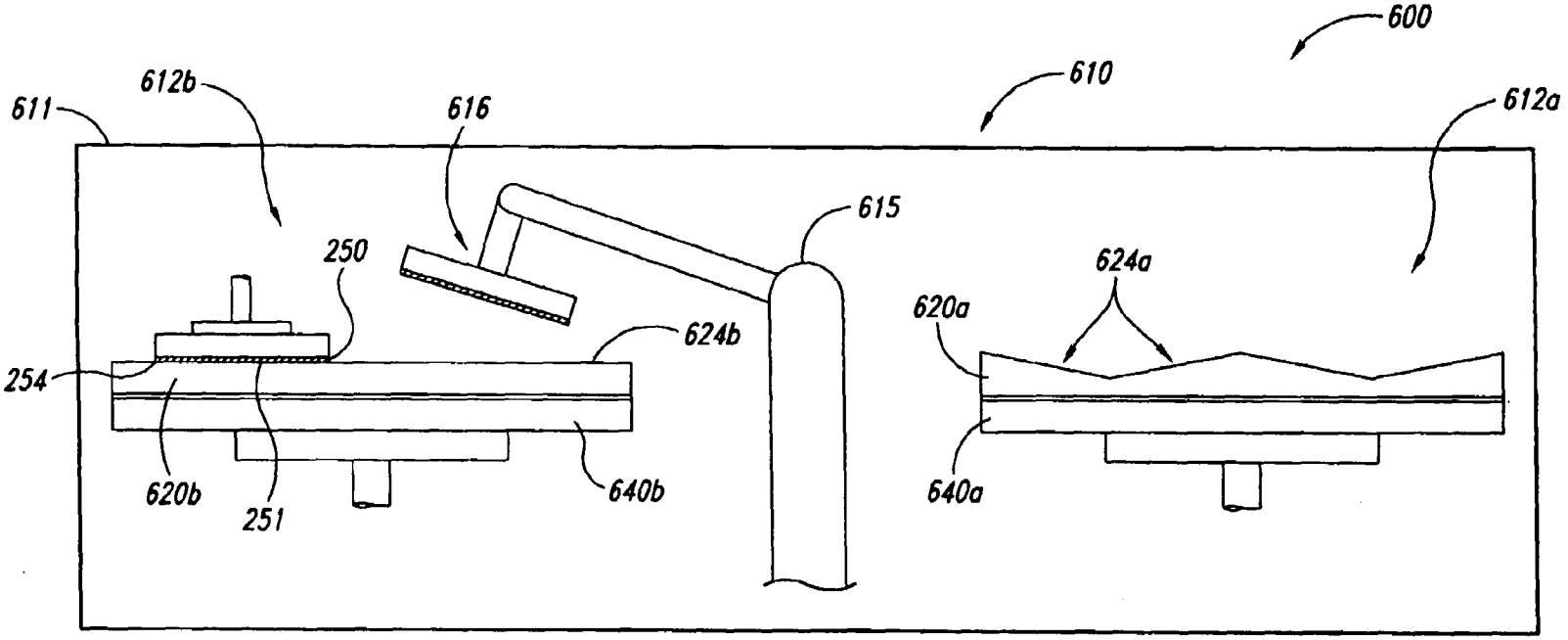
FIG. 6 illustrates a tool having multiple polishing pads to remove material from both the edges and the faces of workpieces, in accordance with another embodiment of the invention.

Polishing pads configured in accordance with any of the embodiments described above with reference to FIGS. 2–5 can be installed on tools and used in combination with other polishing pads to provide multiple functions for workpiece material removal. For example, referring now to FIG. 6, a system 600 can include a tool 610 having multiple stations 612 disposed within an enclosure 611 in accordance with an embodiment of the invention. For the purposes of illustration, the stations 612 are shown in FIG. 6 as a first station 612*a* and a second station 612*b*. The tool 610 can also include a robot 615 having an end effector 616 that is configured to releasably engage and disengage microfeature workpieces 250. Accordingly, the robot 615 can move microfeature workpieces 250 from one station 612 to another.

The first station 612*a* can include a first polishing pad support 640*a* carrying a first polishing pad 620*a* having a configuration generally similar to the polishing pad 220 described above with reference to FIG. 2. Accordingly, the first polishing pad 620*a* can include a polishing surface 624*a* having a first portion that forms an outer, annular rim, and a second portion disposed annularly inwardly from the rim. The first polishing pad 620*a* can accordingly be used to remove material from the edge 254 of a microfeature workpiece 250, as described above with reference to FIG. 2.

After material has been removed from the edge 254 of the microfeature workpiece 250, the robot 615 can transfer the microfeature workpiece 250 to the second station 612*b* where material can be removed from the first face 251, for example, using conventional CMP techniques. Accordingly, the second station 612*b* can include a second pad support 640*b* having a generally flat polishing pad 620*b* with a generally flat polishing surface 624*b* configured to remove material from the first face 251.

An advantage of the system 600 describe above with reference to FIG. 6 when compared with existing systems is that the same tool 610 can be used to remove material from both the edges and the faces of microfeature workpieces. Accordingly, the amount of time required to process the workpieces can be reduced because the workpieces need not be moved from one tool to another to perform these functions. The costs associated with manufacturing the workpieces can also be reduced because the edge removal function can be integrated into an existing tool, and accordingly, a separate tool need not be purchased and maintained by the operator. Still a further advantage of this arrangement is that it is versatile. For example, the polishing pad supports 640*a* and 640*b* can be identical or nearly identical, and yet can support polishing pads having different configurations and providing different functions. Accordingly, the operator need not retrofit significant features of the tool 610 and can instead place the desired polishing pad on an existing polishing pad support. If the operator later wishes to change the arrangement of polishing pads (e.g., by replacing the first polishing pad 620*a* with a more conventional second polishing pad 620*b*, or replacing either of these pads with a polishing pad 320 generally similar to that shown in FIG. 3), the operator need only remove the polishing pad from the corresponding polishing pad support and position the new polishing pad in its place.

The polishing pads described above with reference to FIGS. 2–6 have generally circular planform shapes. In other embodiments, the polishing pads can have other shapes. For example, referring now to FIG. 7A, a system 700 can include an elongated polishing pad 720 configured in accordance with another embodiment of the invention. In one aspect of this embodiment, the system 700 has a polishing pad support 740 with a top panel 741 at a work station where an operative portion "W" of the polishing pad 720 is positioned. The top panel 741 is generally a rigid plate to provide a flat, solid surface to which a particular section of the polishing pad 720 may be secured during polishing.

The system 700 can also have a plurality of rollers to guide, position and hold the polishing pad 720 over the top panel 721. The rollers can include a supply roller 747, first and second idler rollers 744*a* and 744*b*, first and second guide rollers 745*a* and 745*b*, and a take-up roller 746. The supply roller 747 carries an unused or pre-operative portion of the polishing pad 720, and the take-up roller 746 carries a used or post-operative portion of the polishing 720. Additionally, the first idler roller 744*a* and the first guide roller 745*a* can stretch the polishing pad 720 over the top panel 741 to hold the polishing pad 720 stationary during operation. A motor (not shown) drives at least one of the supply roller 747 and the take-up roller 746 to sequentially advance the polishing pad 720 across the top-panel 741. Accordingly, clean pre-operative sections of the polishing pad 720 may be quickly substituted for used sections to provide a consistent surface for polishing the microfeature workpiece 250.

The system 700 can also have a carrier assembly 760 that controls and protects the microfeature workpiece 250 during polishing. The carrier assembly 760 can include a head 761 to pick up, hold and release the microfeature workpiece 250 at appropriate stages of the polishing process. The carrier assembly 760 can also have a support gantry 765 carrying a drive assembly 770 that can translate along the gantry 765. The drive assembly 770 can have an actuator 762, a drive shaft 767 coupled to the actuator 762, and an arm 768 projecting from the drive shaft 767. The arm 768 carries the head 761 via a terminal shaft 769 such that the drive assembly 770 orbits the head 761 about an axis G—G (as indicated by arrow R1). The terminal shaft 769 may also rotate the head 761 about its central axis H—H (as indicated by arrow R2).

Figure 7A:
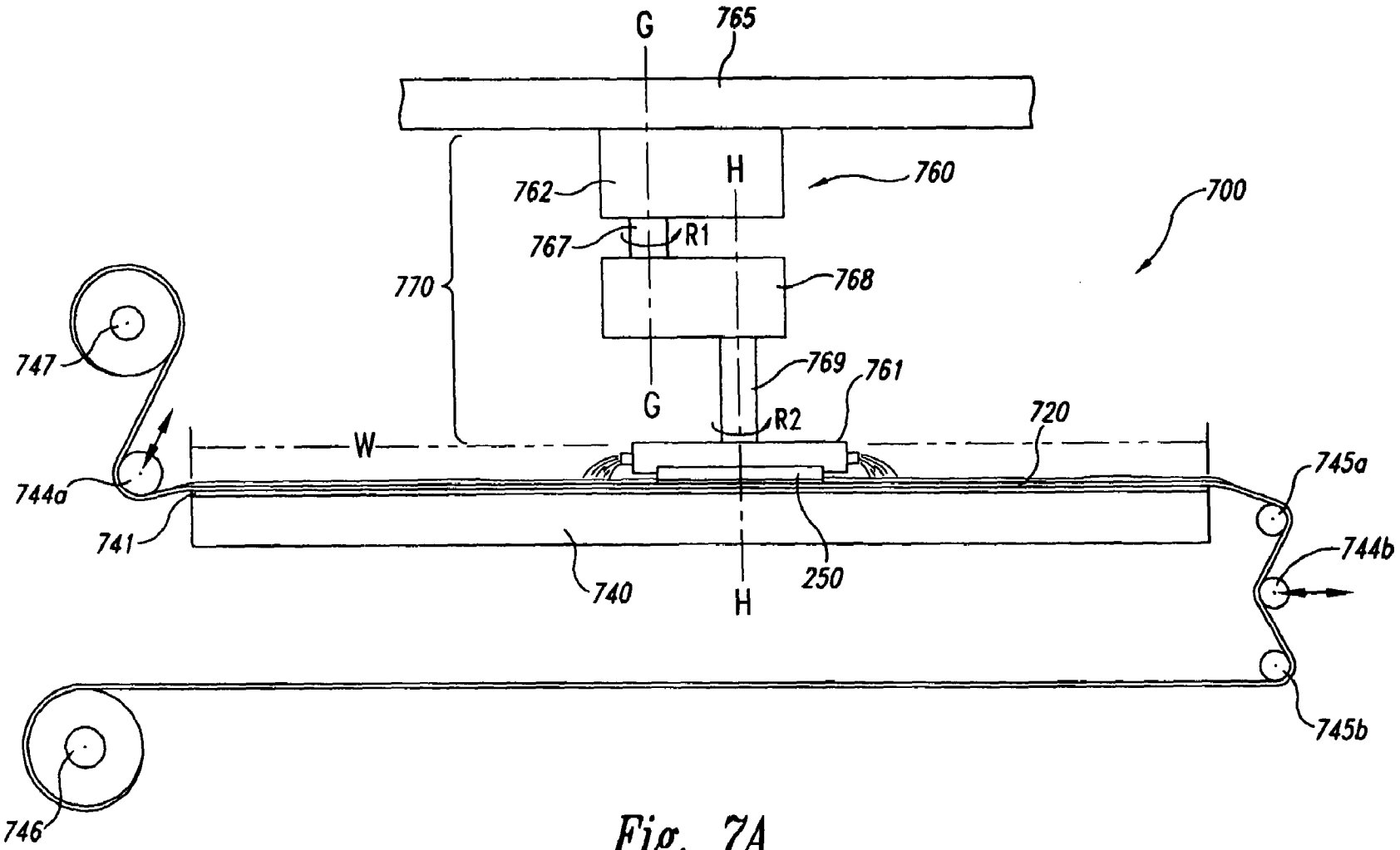
FIGS. 7A and 7B illustrate a web-format polishing tool and pad configured in accordance with another embodiment of the invention.
Figure 7B:
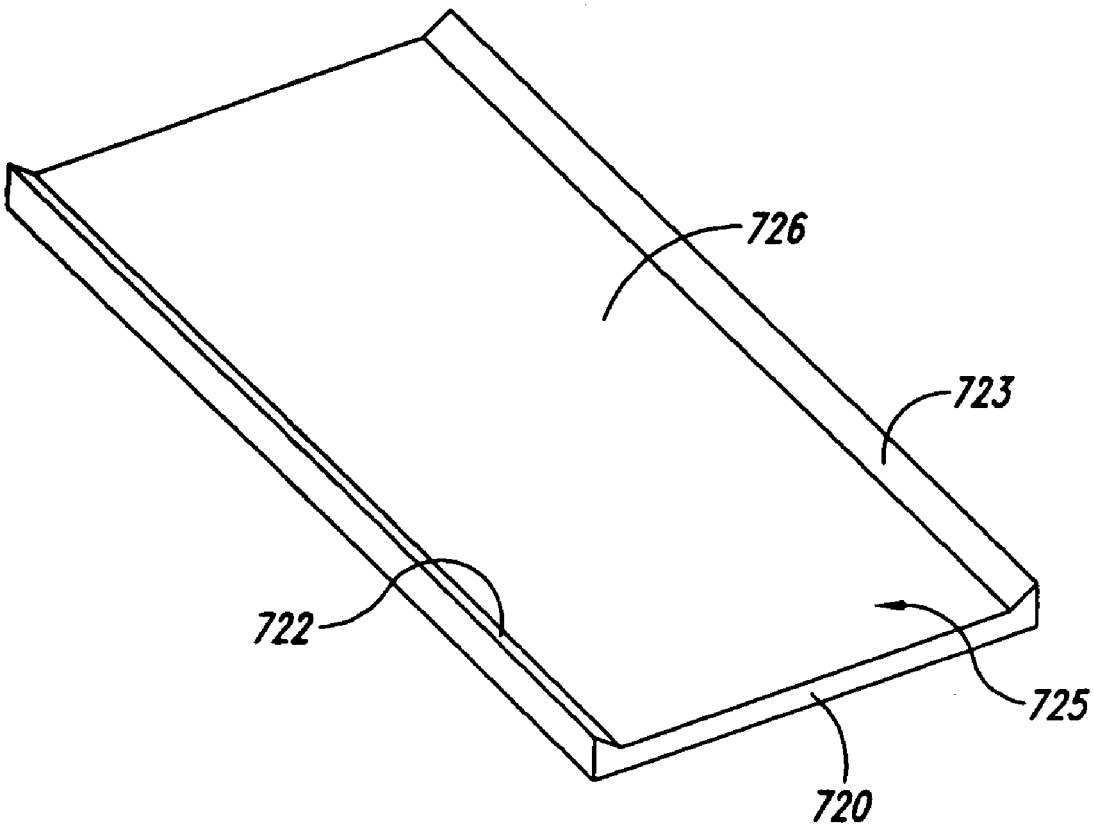

FIG. 7B is a partially schematic, isometric top view of the polishing pad 720 shown in FIG. 7A. In one aspect of an embodiment shown in FIG. 7B, the polishing pad 720 can include a polishing surface 725 having a first portion 722, a second portion 723 facing at least partially toward the first portion 722, and a third portion 726 positioned between the first portion 722 and the second portion 723. Accordingly, the polishing pad 720 can remove material from the edge(s) and face(s) of a microfeature workpiece, in a manner generally similar to that described above with reference to FIG. 3. In other embodiments, the polishing pad 720 can have other features generally similar to those described above.

From the foregoing, it will be appreciated that specific embodiments of the invention have been described herein for purposes of illustration, but that various modifications may be made without deviating from the spirit and scope of the invention. For example, features described above in the context of particular embodiments of the invention can be combined or eliminated in other embodiments. Accordingly, the invention is not limited except as by the appended claims.

I claim:

1. A system for removing material from microfeature workpiece having a first face, a second face facing opposite from the first face, an edge surface between the first and second faces, and an edge at a juncture between the edge surface and one of the first and second faces, the system comprising:

a polishing pad having:

a support surface positioned to face a polishing pad support; and a polishing surface facing generally opposite from the support surface, the polishing surface having a first portion and a second portion facing at least partially toward each other to remove material from the edge of the microfeature workpiece when at least one of the polishing pad and the microfeature workpiece is rotated about an axis oriented at an acute angle relative to the first and second portions, the polishing surface further having a third portion oriented generally normal to the axis to remove material from at least one of the first and second faces of the microfeature workpiece, wherein at least one of the first and second portions includes a recess positioned to convey material away from the polishing surface.

2. The system of claim 1 wherein the polishing pad has a generally circular planform shape and wherein the first and second portions form at least part of a rim extending circumferentially around the third portion.

3. The system of claim 1 wherein the polishing pad has a generally circular planform shape.

4. The system of claim 1 wherein the first portion of the polishing surface is oriented at an at least approximately constant angle relative to the axis.

5. The system of claim 1 wherein the first portion of the polishing surface includes a first region oriented at a first angle relative to the axis, and a second region oriented a second angle relative to the axis, the second angle being different than the first angle.

6. The system of claim 1 wherein the first and second portions have a first composition and the third portion has a second composition different than the first composition.

7. A system for removing material from a microfeature workpiece having a first face, a second face facing opposite from the first face, an edge surface between the first and second faces, and an edge at a juncture between the edge surface and one of the first and second faces, the system comprising:

a carrier positioned to carry a microfeature workpiece with the first face at a polishing plane;

a first polishing pad support;

a first polishing pad carried by the first polishing pad support, the first polishing pad having a first polishing surface oriented generally parallel to the polishing plane;

a second polishing pad support; and a second polishing pad carried by the second polishing pad support, the second polishing pad having a second polishing surface non-parallel to the polishing plane.

8. The system of claim 7, wherein the first polishing pad has a first support surface and the second polishing pad has a second support surface, and wherein first polishing pad support has a first interface surface positioned to contact the first support surface of the first polishing pad, and wherein the second polishing pad support has a second interface surface positioned to contact the second support surface of the second polishing pad.

9. The system of claim 7, further comprising an enclosure disposed around the first polishing pad support, the second polishing pad support and the carrier.

10. The system of claim 7 wherein the first and second polishing pads each have a generally circular planform shape.

11. The system of claim 7 wherein the second polishing pad has a generally circular planform shape and wherein the second polishing surface includes a first portion forming a rim extending circumferentially around at least part of the polishing pad, and a second portion positioned annularly inwardly from the first portion and facing at least partially toward the first portion.

12. The system of claim 7 wherein the second polishing surface is oriented at an at least approximately constant angle relative to the polishing planes.

13. The system of claim 7 wherein the second polishing surface includes a first region oriented at an at a first angle relative to the polishing plane, and a second region oriented a second angle relative to the polishing plane, the second angle being different than the first angle.

14. A method for removing material from a microfeature workpiece, comprising:

positioning a microfeature workpiece at a processing tool, the microfeature workpiece having a first face, a second face facing generally opposite from the first face, an edge surface between the first and second faces, and an edge at a juncture between the edge surface and one of the first and second faces;

contacting the edge of the microfeature workpiece with a polishing surface of a polishing pad while the polishing surface is non-parallel to the first face;

removing material from the edge of the microfeature workpiece by rotating at least one of the microfeature workpiece and the polishing pad relative to the other about an axis generally normal to the first face of the microfeature workpiece while the edge contacts the polishing surface; and removing material from the first face of the microfeature workpiece without removing the microfeature workpiece from the processing tool: wherein removing material from the edge of the microfeature workpiece includes removing material from the edge while the microfeature workpiece is positioned at a first station of the processing tool, and wherein removing material from the first face of the microfeature workpiece includes removing material from the first face while the microfeature workpiece is positioned at a second station of the processing tool, and wherein the method further comprises moving the microfeature workpiece from the first station to the second station without removing the microfeature workpiece from the processing tool.

15. The method of claim 14 wherein positioning the microfeature workpiece at a processing tool includes placing the microfeature workpiece within an enclosure of the tool, and wherein removing material from the first face of the microfeature workpiece includes removing material from the first face without removing the microfeature workpiece from the enclosure.

16. The method of claim 14 wherein the polishing surface has a first portion, a second portion facing at least partially toward the first portion, and a third portion oriented generally normal to the axis, and wherein removing material from the edge of the microfeature workpiece includes contacting the edge with at least one of the first and second portions, further wherein removing material from the first face of the microfeature workpiece includes engaging the first face with the third portion.

17. A method for removing material from a microfeature workpiece, comprising:

carrying a microfeature workpiece having a first face, a second face facing generally opposite from the first face, an edge surface between the first and second faces, and an edge at a juncture between the edge surface and one of the first and second faces;

contacting the edge of the microfeature workpiece with a polishing surface of a first polishing pad while the polishing surface is non-parallel to the first face and while the first polishing pad is removably carried by a first polishing pad support having a first pad interface surface;

removing material from the edge of the microfeature workpiece by rotating at least one of the microfeature workpiece and the first polishing pad relative to the other about an axis generally normal to the first surface of the microfeature workpiece while the edge contacts the polishing surface;

contacting the first face of the microfeature workpiece with a polishing surface of a second polishing pad while the polishing surface is generally parallel to the first face and while the second polishing pad is removably carried by a second polishing pad support having a second pad interface surface at least approximately the same as the first pad interface surface; and removing material from the first face of the microfeature workpiece by moving at least one of the microfeature workpiece and the second polishing pad relative to the other.

18. The method of claim 17 wherein contacting the first face of the microfeature workpiece includes contacting the first face with a second polishing pad carried by a second polishing pad support having a size and shape at least approximately the same as a size and shape of the first polishing pad support.

19. A system for removing material from microfeature workpiece having a first face, a second face facing opposite from the first face, an edge surface between the first and second faces, and an edge at a juncture between the edge surface and one of the first and second faces, the system comprising:

a polishing pad having:

a support surface positioned to face a polishing pad support; and a polishing surface facing generally opposite from the support surface, the polishing surface having a first portion and a second portion facing at least partially toward each other to remove material from the edge of the microfeature workpiece when at least one of the polishing pad and the microfeature workpiece is rotated about an axis oriented at an acute angle relative to the first and second portions, the polishing surface further having a third portion oriented generally normal to the axis to remove material from at least one of the first and second faces of the microfeature workpiece, wherein the first and second portions have a first composition and the third portion has a second composition different than the first composition.

20. The system of claim 19 wherein the polishing pad has a generally circular planform shape and wherein the first and second portions form at least part of a rim extending circumferentially around the third portion.

21. The system of claim 19 wherein the polishing pad has a generally circular planform shape.

22. The system of claim 19 wherein the first portion of the polishing surface is oriented at an at least approximately constant angle relative to the axis.

23. The system of claim 19 wherein the first portion of the polishing surface includes a first region oriented at a first angle relative to the axis, and a second region oriented a second angle relative to the axis, the second angle being different than the first angle.

* * * * *